US009981793B2

(12) United States Patent
Kenmotsu et al.

(10) Patent No.: US 9,981,793 B2
(45) Date of Patent: May 29, 2018

(54) GUSSET BAG WITH SPOUT

(71) Applicant: HOSOKAWA YOKO CO., LTD., Tokyo (JP)

(72) Inventors: Toshikazu Kenmotsu, Tokyo (JP); Kazuhiro Umenaka, Tokyo (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 0 days. days.

(21) Appl. No.: 14/400,108

(22) PCT Filed: May 9, 2013

(86) PCT No.: PCT/JP2013/063015
§ 371 (c)(1),
(2) Date: Nov. 10, 2014

(87) PCT Pub. No.: WO2013/168756
PCT Pub. Date: Nov. 14, 2013

(65) Prior Publication Data

US 2015/0125097 A1 May 7, 2015

(30) Foreign Application Priority Data

May 10, 2012 (JP) ..... 2012-108744

(51) Int. Cl.
*B65D 75/58* (2006.01)
*B65D 33/16* (2006.01)
(Continued)

(52) U.S. Cl.
CPC ..... *B65D 75/5866* (2013.01); *B65D 31/10* (2013.01); *B65D 33/16* (2013.01); *B65D 75/008* (2013.01); *B65D 75/5883* (2013.01)

(58) Field of Classification Search
CPC .... B65D 75/5866; B65D 31/10; B65D 33/16; B65D 75/008; B65D 75/5883;
(Continued)

(56) References Cited

U.S. PATENT DOCUMENTS 6,224,528 B1 * 5/2001 Bell ..... B29C 65/18 493/196
6,679,304 B1 1/2004 Vacca
2002/0141664 A1 * 10/2002 Matsuda ..... B65D 75/5866 383/40

FOREIGN PATENT DOCUMENTS

JP 584889 10/1982
JP 11-147547 6/1999
(Continued)

OTHER PUBLICATIONS

International Search Report, PCT/JP2013/063015, dated Jun. 4, 2013.

*Primary Examiner* — Christopher Demeree
(74) *Attorney, Agent, or Firm* — Young & Thompson

(57) ABSTRACT

A gusset bag has a spout that keeps a stable self-standing attitude, facilitating easy and complete content pouring. The gusset bag includes a film bag body and a spout attached to the bag body. The bag body includes a tubular body and a rectangular-shaped bottom surface sealed and secured to one edge of the tubular body. The tubular body includes opposing flat surfaces and side surfaces, each being sealed and secured to side edges of the flat surfaces, the bottom surface and the side surfaces being formed with foldable lines, respectively, along which the bottom surface and the side surfaces are folded inward toward inside of the bag body, forming a bottom surface gusset and side surface gussets, and an inclining edge is formed to one of the upper two corners of the bag body, the spout being attached to the inclining edge.

2 Claims, 10 Drawing Sheets

(51) Int. Cl.
*B65D 75/00* (2006.01)
*B65D 30/20* (2006.01)

(58) Field of Classification Search
CPC ..... B65D 2575/583; B65D 75/5861; B65D 77/065; B65D 83/28
USPC ..... 383/104, 107, 120; 222/566
See application file for complete search history.

(56) References Cited

FOREIGN PATENT DOCUMENTS

| | | |
|---|---|---|
| JP | 11-292105 | 10/1999 |
| JP | 2000-072161 | 3/2000 |
| JP | 2003-267402 | 9/2003 |
| JP | 2002-179102 | 6/2006 |
| JP | 2008-044641 | 2/2008 |
| KR | 2003-0062284 | 7/2003 |
| WO | WO 2004/110875 | 12/2004 |

* cited by examiner

GUSSET BAG WITH SPOUT

TECHNICAL FIELD

The present invention relates to a gusset bag with a spout, and more particularly, to a gusset bag with a spout capable of ensuring stable self-standing performance regardless of remaining amount of an inner content remaining in a bag and easily pouring out the inner content completely regardless of the remaining amount of the inner content.

BACKGROUND ART

In conventional technology, there is known a gusset bag provided with a spout as a gusset-type bag formed of a film material such as polyester in which a spout is attached to an upper edge portion of the gusset-type bag. Patent Document 1 (Japanese Patent Laid-open Publication No. 2002-179102), as one example of such gusset-type bag, discloses a following gusset bag with a spout. Hereunder, this gusset bag provided with the spout is referred to as a conventional gusset bag A, which will be explained with reference to the accompanying drawing.

FIG. 10 is a perspective view illustrating a conventional gusset bag A.

As shown in FIG. 10, the conventional gusset bag A is composed of a bag body 11 and a spout 12 provided with a cap 3. The spout 12 is attached to the upper edge portion of the bag body 11 so as to allow an interior of the bag body 11 to communicate with an exterior of thereof.

The bag body 11 is formed from a pair of opposing flat surface portions 14, a pair of side surface portions 15 having side edge portions heat-sealed to side edge portions of the respective flat surface portions 14 so as to have a side surface gusset forming foldable lines (L1), and a bottom surface portion 16 formed to a lower edge portion of the bag body 11. The bottom surface portion 16 is formed in a manner in which lower portions of the paired flat surface portions, to which the side surface portions 15 are sealed, are folded inward each by a predetermined length.

The conventional gusset bag A, however, provides the following defects.

In a case when much inner content remains in the bag body 11, the bottom surface portion 16 can maintain a flatness to some extent because of self-weight of the inner content and ensure its self-standing performance, but when the amount of the remaining inner content reduces, it becomes difficult to maintain inwardly folded condition of the lower portions of the paired flat surface portions 14. As a result, it becomes impossible for the bottom surface portion to maintain its flatness and hence difficult to ensure the stable self-standing ability.

When the remaining amount of the inner content reduces, if the self-standing performance is not ensured, the following problem will be caused.

For example, the conventional gusset bag A is used as a soy-source bag, which is repeatedly used, the bog body 11 is liable to fall over according to reducing of the remaining amount of the soy-source and difficult to be used as soy-source bag, and in a certain case, there may cause a feat that the bag body 11 itself falls over and the soy-source flows outward.

Then, a gusset bag provided with a spout that solved the problem encountered in the conventional gusset bag A mentioned above has been proposed as one example that is disclosed in Patent Document 2 (Japanese Patent Laid-open Publication No. 2008-44641). Hereunder, this gusset bag is referred to as conventional gusset bag B, which will be explained with reference to the accompanying drawing.

FIG. 11 is a perspective view illustrating the conventional gusset bag B.

As shown in FIG. 11, the conventional gusset bag B is composed of a bag body 21 and a spout 22 provided with a cap 27. The spout 22 is attached to the central position of the upper edge portion of the bag body 21 so as to allow an interior of the bag body 21 to communicate with an exterior thereof.

The bag body 21 is formed from a tubular body portion 23 and a bottom surface portion 24 heat-sealed to a lower edge portion of the tubular body portion 23. The tubular body portion 23 is composed of a pair of opposing flat surface portions 25 and a pair of side surface portions 26 heat-sealed to the side edge portions of the paired flat surface portions 25. The side surface portions 26 are formed with foldable lines (L2), respectively, for forming side surface gussets.

The bottom surface portion 24 has entire peripheral edge portion (margin) to be heat-sealed and secured to the flat surface portions 25 forming the tubular body portion 23 and the inner surface of the lower edge portions (margins) of the side surface portions 26. The bottom portion 24 is folded into a boat-shape to thereby form a bottom surface gusset of the bag body 21 (see FIG. 6).

According to the conventional gusset bag B, by heat-sealing the bottom surface portion 24 to the lower edge portion of the tubular body portion 23, the bottom surface portion 24 can always maintain its flatness and hence ensure self-standing attitude regardless of remaining amount of the inner content.

The conventional gusset bag B, however, provides the following defects.

When it is required to pour out the inner content, the bag body 21 is inclined. However, if the remaining amount of the inner content is reduced, it is difficult to pour out the inner content as long as the bag body 21 is largely inclined because the spout 22 is attached to the central portion of the upper edge portion of the bog body 21, and accordingly, there is a fear that some amount of the inner content remains inside the bag body 21.

The above defect may be solved to some extent by attaching the spout 22 to a corner portion of the bag body 21.

Then, a gusset bag provided with a spout in which the spout is attached to the corner portion of the bag body is disclosed in Patent Document 3 (Japanese Design Patent Registration No. 584889). Hereunder, this gusset bag provided with the spout disclosed in this Document 3 is referred to as conventional gusset bag C, which will be explained with reference to the accompanying drawing.

FIG. 12 is a perspective view showing the conventional gusset bag C.

As shown in FIG. 12, the conventional gusset bag C is composed of a bag body 41 formed with a pair of flat surface portions 42 and a spout 43, provided with a cap 44, attached to one of upper corner portions of the bag body 41.

In the conventional gusset bag C, since the spout 43 is attached to the upper corner portion of the bag body 41, the inner content is easily taken out, but since any gusset is not formed to the side portion of the bag body 41, the self-standing ability of the bag body 41 becomes worse when the remaining amount of the inner content is reduced, thus being inconvenient.

Furthermore, another-type of a gusset bag provided with a spout to a corner portion of a bog body is disclosed in Patent Document 4 (Japanese Patent Laid-open Publication No. HEI 11-292105), and hereunder, this gusset bag will be referred to as a conventional gusset bag D and explained with reference to the drawings.

FIG. 13 is a perspective view of the conventional gusset bag D.

As shown in FIG. 13, the conventional gusset bag D is composed of a bag body 53 which has a longitudinally long length and has both end portions each of which has a sealed head-like shape of a milk carton, and a spout 54 provided with a cap 55 attached to either one end seal portion of the bag body 53.

According to the structure of the above conventional gusset bag D, the inner content can be easily taken out and the gusset bag D has an excellent self-standing performance. On the other hand, it is difficult to stock the bag D because of its wide width, and moreover, since the spout 54 is attached to the end seal portion of the bag body 53, it is difficult to completely pour out the inner content even if the bag body 53 is inclined and some amount of inner content remains inside the bag body 53, thus being inconvenient.

PRIOR ART DOCUMENT

Patent Document

Patent Document 1: Japanese Patent Laid-open Publication No 2002-179102.

Patent Document 2: Japanese Patent Laid-open Publication No. 2008-44641.

Patent Document 3: Japanese Design Patent Registration No. 584889.

Patent Document 4: Japanese Patent Laid-open Publication No. HEI 11-292105.

SUMMARY OF THE INVENTION

Problems to be Solved by the Invention

As described above, for all the above-mentioned conventional gusset bags A to D, it is impossible to satisfy both features of insurance of stable self-standing performance or ability regardless of remaining amount of the inner content and ability of easily and completely pouring out the inner content with no residual.

Therefore, an object of the present invention is to provide a gusset bag provided with a spout capable of ensuring a stable self-standing performance or ability regardless of remaining amount of the inner content and ability of easily and completely pouring out the inner content with no residual.

Means for Solving the Problem

In order to achieve the above object, the present invention is provided with the following characteristic features.

The invention defined in claim 1 provides a gusset bag provided with a spout comprising a bag body made of a film material and a spout attached to the bog body, the bag body being composed of a tubular body portion and a rectangular-shaped bottom surface portion sealed to one edge portion of the tubular body portion, wherein the tubular body portion is composed of a pair of opposing flat surface portions and a pair of side surface portions each of which is sealed to side edge portions of the flat surface portions, the bottom surface portion and the side surface portions are formed with foldable lines, respectively, along which the bottom surface portion and the side surface portions are folded inward toward inside of the bag body so as to form a bottom surface gusset and side surface gussets, and an inclining edge portion is formed to one of the upper two corner portions of the bag body, the spout being attached to the inclining edge portion.

The invention defined in claim 2 is characterized, in the invention claimed in claim 1, in that a portion to be opened is formed to an upper portion of one of the side surface portions to which the spout is attached.

The invention defined in claim 3 is characterized, in the gusset bag with the spout claimed in claim 1 or 2, in that the spout is attached at a right angle to the inclining edge portion of the bag body.

Effect of the Invention

According to the present invention, the stable self-standing performance or ability regardless of an amount remaining in the bag body by sealing and securing the rectangular-shaped bottom surface portion to which the foldable line for forming the bottom gusset is formed to the lower edge portion of the tubular body portion forming the bag body. Moreover, since the inclining edge portion is formed to the bag body by obliquely cutting an upper corner portion of the bag body and the spout is attached to this inclining edge portion, so that the inner content can be easily completely poured out regardless of the remaining amount of the inner content. Furthermore, the high liquid-sealing performance can be achieved and ensured at the time when the spout is attached to the bag body by forming a portion to be opened to the upper portion of one of the side surface portions to which the spout is attached.

EMBODIMENT FOR CARRYING OUT THE INVENTION

Hereunder, one embodiment of a gusset bag provided with a spout according to the present invention will be explained with reference to the accompanying drawings. It is to be noted that the gusset bag provided with a spout is referred to as "gusset bag E of the present invention" or merely "gusset bag E".

Figure 1:
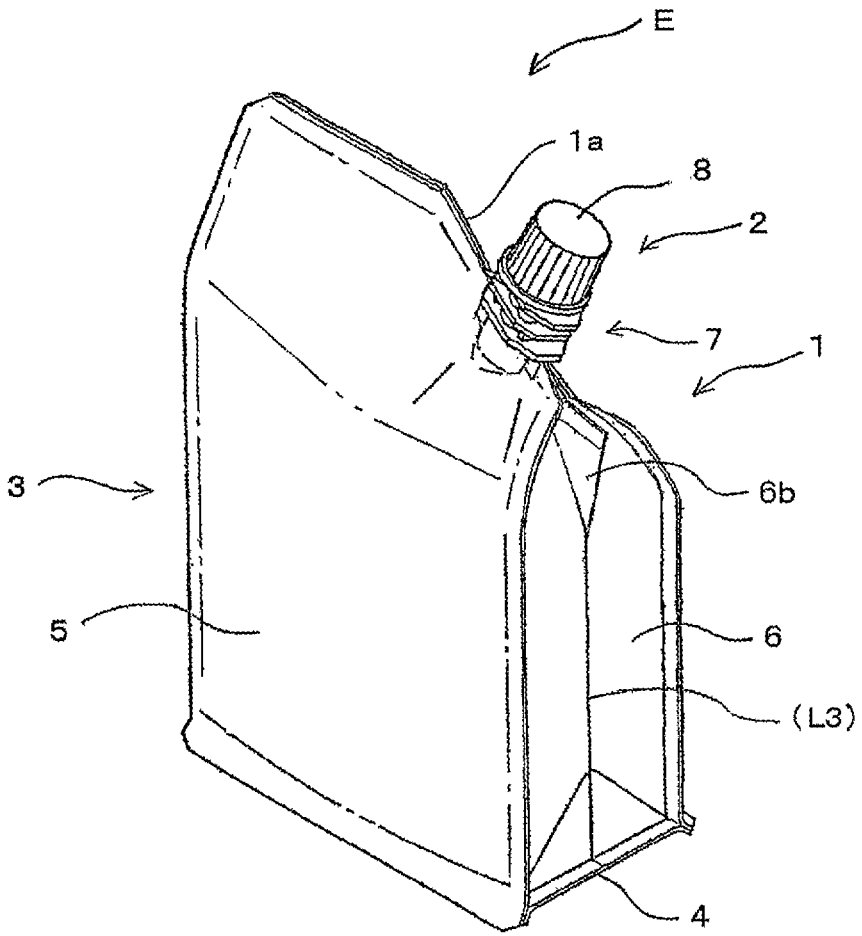
FIG. 1 is a perspective view showing a gusset bag E according to the present invention.

FIG. 1 is a perspective view illustrating the gusset bag E of the present invention.

As shown in FIG. 1, the gusset bag E of the present invention is composed of a bag body 1 made of a film material such as polyester or like and a spout 2 attached to the bog body 1 so as to make communication between an interior and an exterior of the bog body 1. The spout 2 is sandwiched between a pair of flat surface portions 5, which is explained hereinafter, and attached to the bag body 1 by means of heat-sealing.

The bag body 1 is composed of a tubular body portion 3 and a bottom surface portion 4 secured to the lower edge portion of the tubular body portion 3 by means of heat-sealing. An inclined edge portion 1*a* is formed to an upper corner portion of the bag body 1 by cutting off an upper portion of the flat surface portions, which is explained hereinafter. It is further to be noted that the term "upper" for the bag body is used herein to a side to which a spout is attached and the term "lower" of the bag body is used herein to a side to which the bottom portion thereof is formed.

The tubular body portion 3 is formed with a pair of flat surface portions 5 and a pair of side surface portions 6 each of which are secured by means of heat-sealing between side edge portions of the flat surface portions 5. The heat-sealed portions between the flat surface portions 5 and the side surface portions 6 are denoted by adding character (W1) in FIG. 5. A portion 6*b* to be opened that achieves effective function at the time of attaching the spout 2 to the bag body 1 is formed to an upper portion of the side surface portion 6 on the side to which the spout 2 is attached. Such opening 6*b* may be formed to an upper portion of another one of the side surface portions 6. This portion 6*b* to be opened by pulling out an upper portion of the side surface portion 6 after forming the inclined portion by cutting is referred to hereunder as opening portion 6*b* achieving specific function which will be explained hereinafter.

Each of the flat surface portion 5 has a vertically elongated rectangular shape having an upper edge portion including two corner portions, and one of these two corner portions is cut off in an oblique direction so as to inclining edge portion 1*a*. Each of the side surface portions 6 is formed with a vertically extending foldable (folded) line (L3) at a central portion in the thickness direction. By enabling the side surface portions 6 to be folded inward of the bag body 1 along the foldable lines (L3), side surface gussets are formed in both side portions of the bag body 1.

Figure 6:
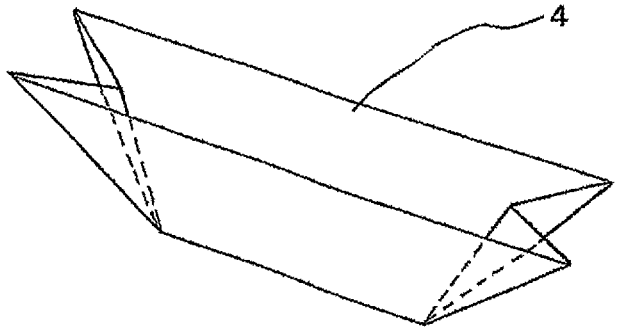
FIG. 6 is a perspective view of the bottom surface portion that is bent into a boat-shape.

The bottom surface portion 4 has a rectangular shape having a longitudinal dimension equal to a width dimension of the flat surface portion 5, and the width dimension of the bottom portion 4 is equal to the width dimension of the side surface portion 6. An entire peripheral edge portion of the bottom surface portion 4 is sealed and secured to the inner surface portions of the lower edge portions of the flat surface portions 5 and the side surface portions 6 forming the tubular body portion 3 by means of heat-sealing. As shown in FIG. 6, the bottom surface portion 4 is formed with a bottom surface gusset of the bottom portion of the bag body by folding the bottom surface portion into a boat-shape.

Figure 3:
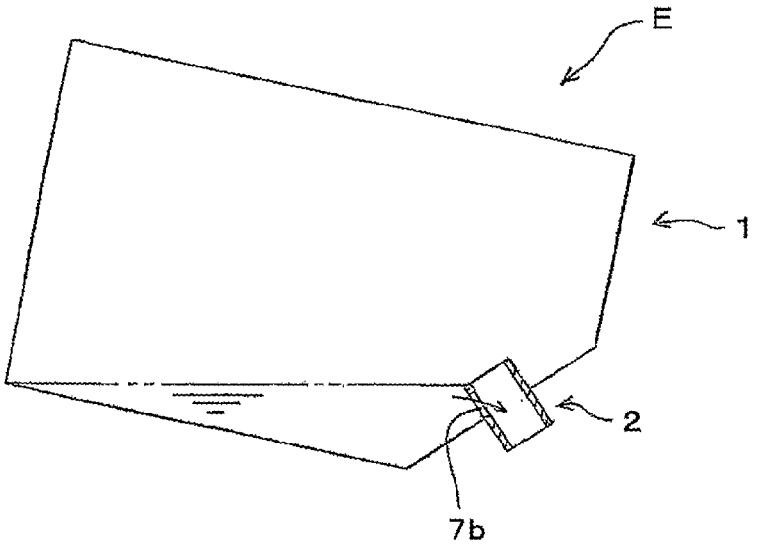
FIG. 3 is an explanatory view in a case where a small amount of residual remaining in the bag body is poured out.

The spout 2 is composed, as shown in FIG. 6, of a pipe-shaped spout body 7 provided with a pouring port 7*a* and a cap 8, and is attached to the inclining edge portion of the bog body 1 perpendicularly to the inclined edge surface at the right angle. The spout body 7 is formed with an attachment portion 9 heat-sealed to the bag body 9, flanged portions 10*a*, 10*b*, 10*c* and a male screw portion 7*c* to be engaged with the cap 8. Long slits 7*b* are formed to the lower portion of the spout body 7 to be capable of pouring inner content out of the bag body 1 even if the bag body 1 is press-crushed. Moreover, when a small amount of the residual of the inner content remaining in the bag body is to be poured out, the long slits 7*b* attains a function of easily and securely pouring the entire inner content out of the bag body 1 without largely inclining the bag body 1 by synergistic effect with the spout attachment to the inclining edge portion of the bog body 1 as shown in FIG. 3.

Next, function of the opening portion 6*b* (portion to be opened) will be explained with reference to the accompanying drawings.

Figure 2:
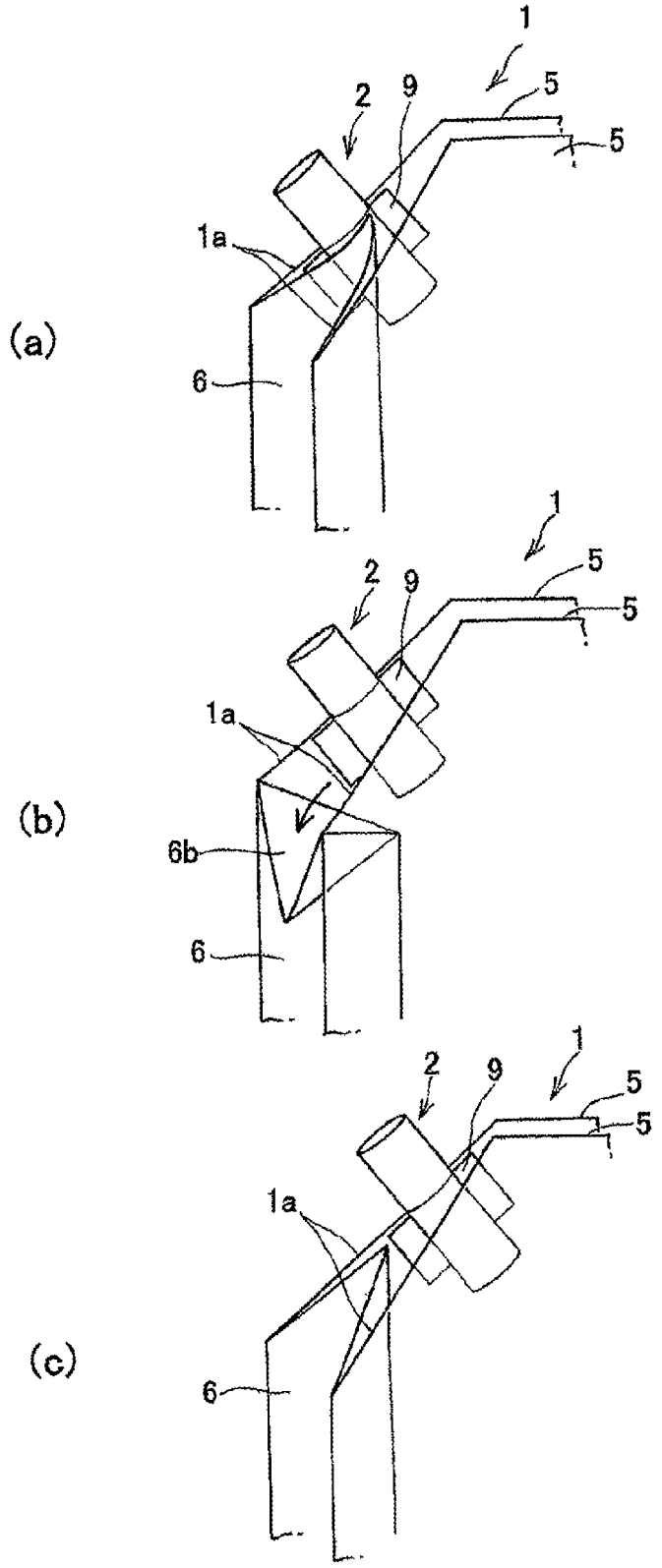
FIG. 2 shows a manner for attaching a spout, in which (a) is a schematic view illustrating a spout attaching manner in a case where any opening portion is not formed for a gusset bag, (b) is a schematic view illustrating a spout attaching manner in a case where an opening portion is formed, and (c) is a schematic view illustrating another spout attaching manner in a case where a spout is attached.

FIG. 2 is a schematic perspective view for the explanation of attaching (mounting) the spout, in which (a) is a view explaining an attachment of the spout in the case where any opening portion is not formed, (b) is a view explaining the attachment in the case an opening portion is formed, and (c) is a view explaining another spout attachment manner.

More specifically, the upper end portion of one side surface portion 6, which will be cut with inclination, is folded inward before cutting it and attaching the spout 2, and as shown in FIG. 2(*b*), this upper end portion is then pulled out to be opened outward as an opening portion 6*b*, and the upper end portion is then cut with inclination with the opening portion 6*b* being pulled out.

Figure 4:
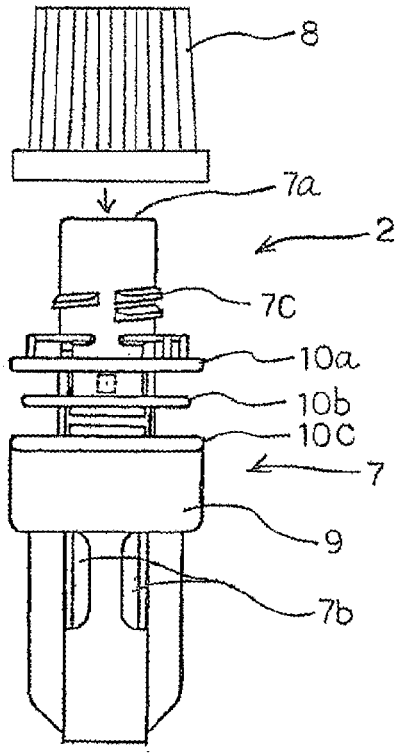
FIG. 4 is a front view showing a spout.

As mentioned above, after one end side of the upper edge portion of the tubular body portion 3 is cut with inclination, the spout 2 is then attached to the bag body 1 in a manner sandwiched between a pair of the inclined flat surface portions 5 and at substantially right angle with the cut inclined surface, and the paired flat surface portions 5 are then heat-sealed. The heat-sealed portion of the spout 2 is formed as the attachment portion 9 (see FIG. 4), and the upper end portion of the opening portion 6*b* is also heat sealed.

In the structure where any opening portion 6*b* is not formed, one of the flat surface portion 5 (back side on the drawing) as shown in FIG. 2(*a*), directly contacts at least a part of the attachment portion 9, but the other one of the flat surface portion 5 (front side on the drawing) contacts the attachment portion 9 in a manner such that the other one flat surface portion 5 is overlapped with the folded side surface portion 6 through a part thereof. Of course, since the thickness of the overlapped portion becomes thicker than the thickness of the other portion, the contacting pressure of a heat plate at the heat-sealing treatment becomes uneven. As a result, liquid-tightness between the spout 2 and the bag body 1 is damaged, which may result in leakage of the inner content.

On the other hand, as shown in FIG. 2(*b*), when the opening portion 6*b* is formed by pulling out the upper portion of the side surface portion (side gusset portion) 6 to be opened outward in an arrowed direction shown in FIG. 2(*b*), an overlapped portion such as one mentioned above is not formed, and hence, the attachment portion 9 of the spout 2 directly contacts the paired flat surface portion 5, and accordingly, the contacting pressure by the heat plate becomes even, thus preventing a fear of damaging the proper liquid-tightness.

Another method of not forming an overlapped portion is shown in FIG. 2(*c*), in which a portion to which the spout 2 is attached is shifted to an upper end side portion of the inclining edge portion 1*a* of the bag body 1. In such method, although the overlapped portion is not formed, the attached position of the spout 2 is offset from the central portion of the inclining edge portion 1*a*, so that the gusset bag cannot be kept in its balance, resulting in providing of a bad appearance. Moreover, in order to form no overlapped portion and position the spout 2 to the central portion of the inclining edge portion 1*a*, it will be necessary to make long the length of the inclining portion 1*a*, but if the length is made longer, the bag body 1 becomes inevitably large, resulting in cost increasing.

As mentioned above, the formation of the opening portion 6*b* makes it possible to attain a function of attaching the spout 2 to the predetermined position without making large the bag body 1 while keeping good liquid-tight performance.

Hereunder, a securing (i.e., sealing) method of the bottom surface portion 4 to the tubular body portion 3 will be explained.

Figure 5:
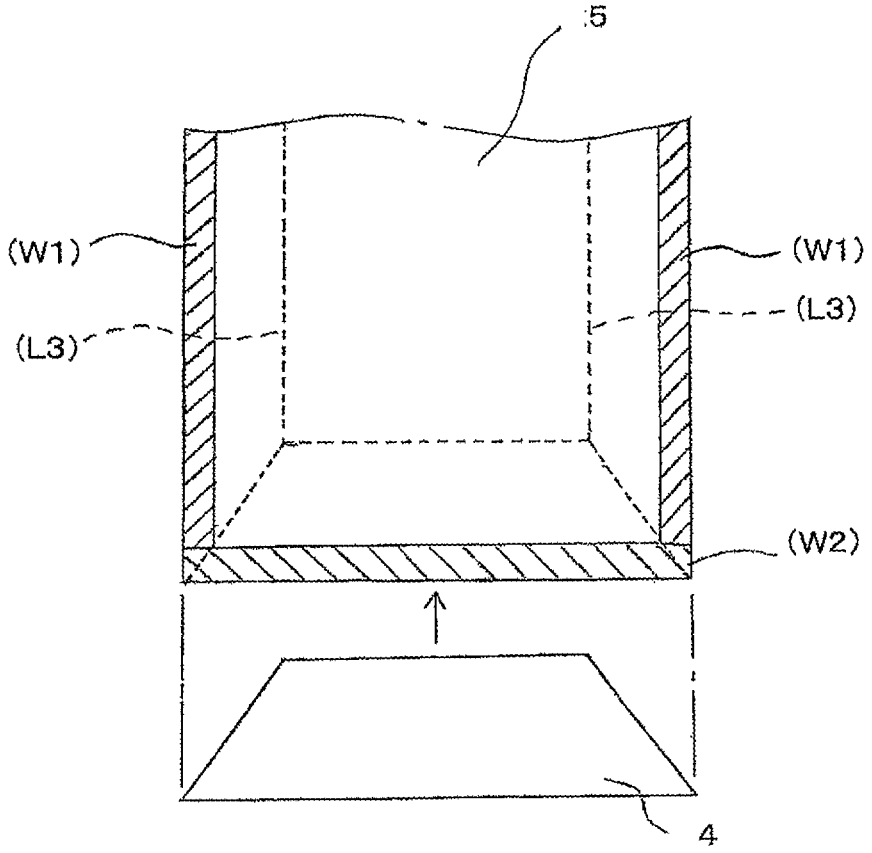
FIG. 5 is a front view showing a state in which a bottom surface portion of the bag is inserted into a tubular body portion of the bag body.

First, as shown in FIG. 6, the bottom surface portion 4 is folded into a boat-shape. Next, as shown in FIG. 5, the bottom surface portion 4 folded into the boat-shape is inserted into the lower portion of the tubular body portion 3. Thereafter, a heat plate is pressed against the lower edge portion of the flat surface portions. A portion to be heat-sealed by pressing the heat plate is shown with (W2) in FIG. 5. According to such manner, the entire peripheral edge portion of the bottom surface portion 4 and the lower edge portion of the tubular body portion 3 is heat-sealed to thereby secure the bottom surface portion 4 to the lower edge portion of the tubular body portion 3.

Another method of securing the bottom surface portion 4 to the lower edge portion of the tubular bag body 3 will be explained hereunder also with reference to the drawing.

Figure 7:
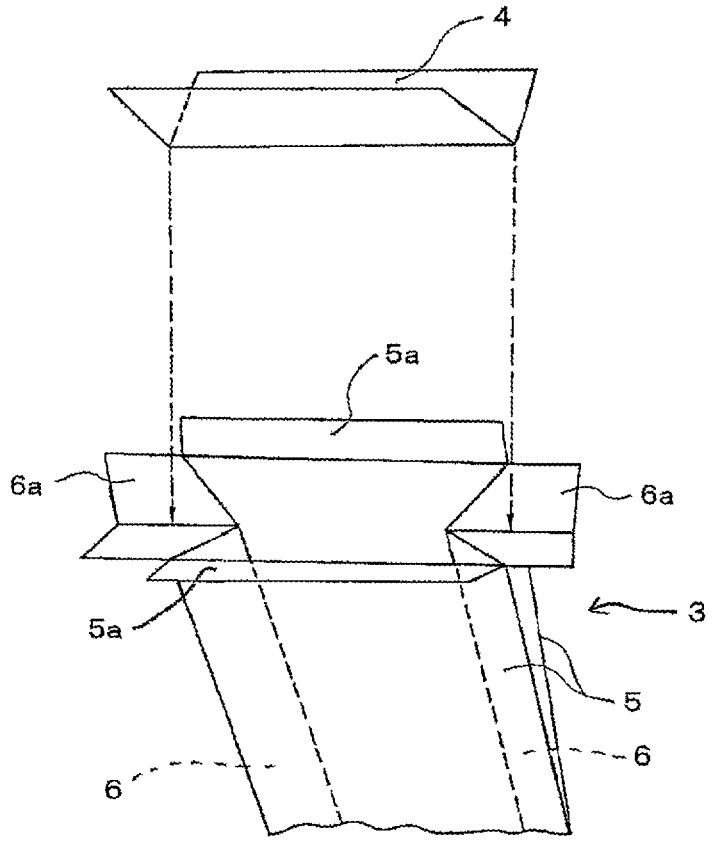
FIG. 7 is a partial perspective view illustrating a manner for overlapping the bottom surface portion to an opened lower portion of the tubular body portion of the bag.
Figure 8:
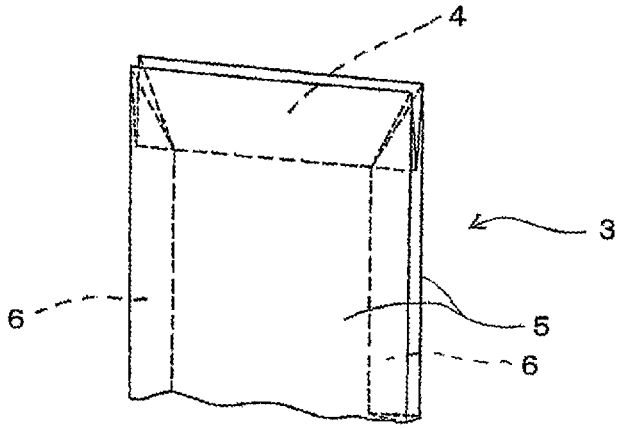
FIG. 8 is a partial perspective view illustrating a state in which the bottom surface portion is overlapped to the lower portion of the opened tubular body portion of the bag and an excess portion is then cut off.
Figure 9:
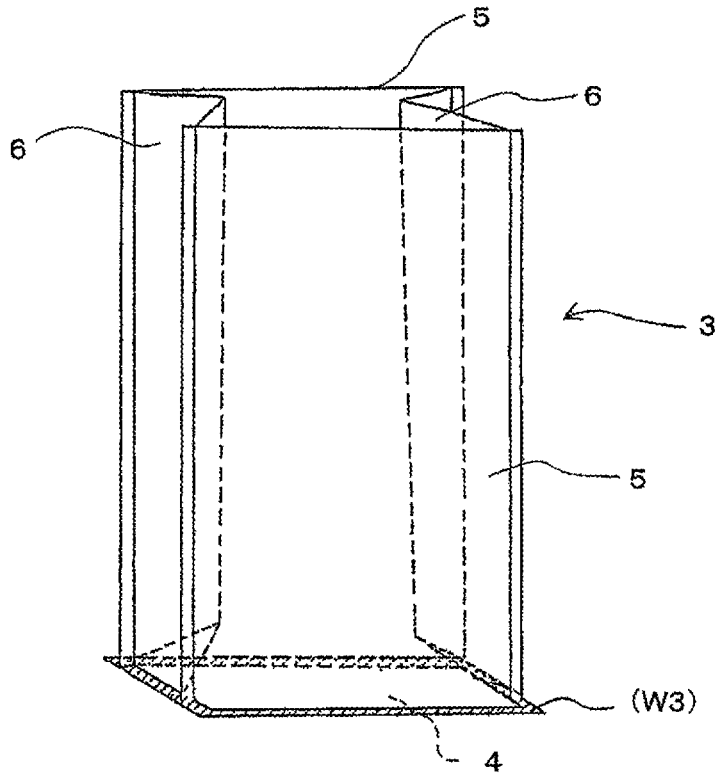
FIG. 9 is a perspective view illustrating the tubular body portion of the bag to which the bottom surface portion is heat-sealed.
Figure 10:
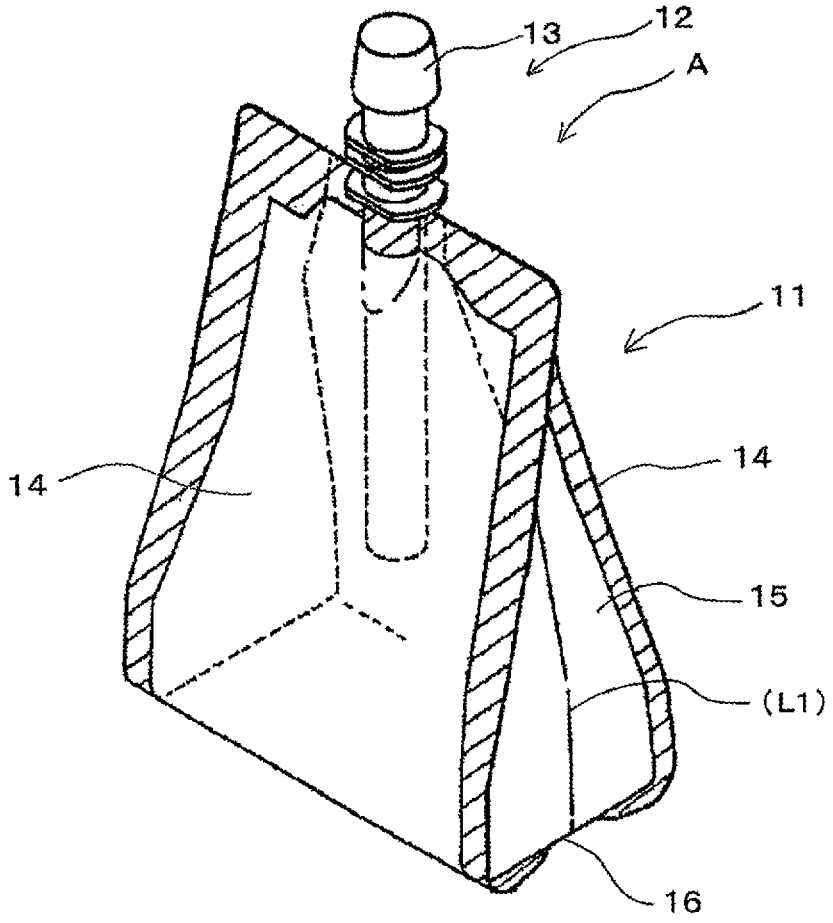
FIG. 10 is a perspective view illustrating a conventional gusset bag A.
Figure 11:
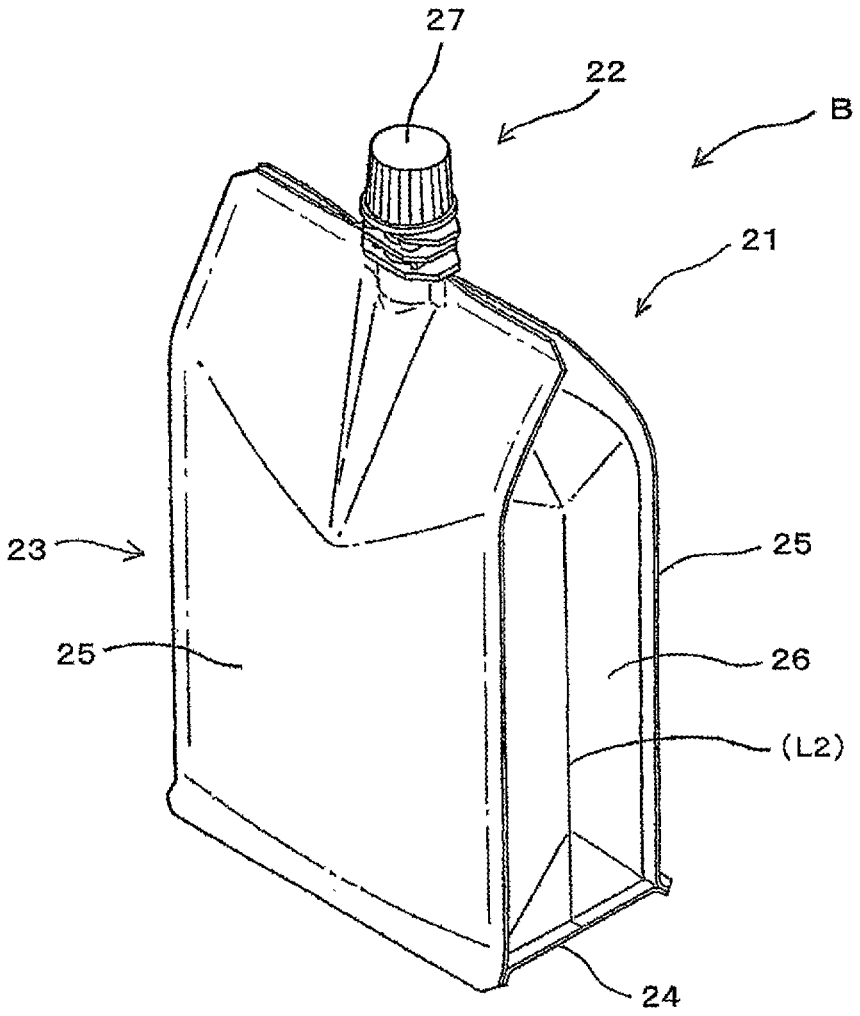
FIG. 11 is a perspective view illustrating a conventional gusset bag B.
Figure 12:
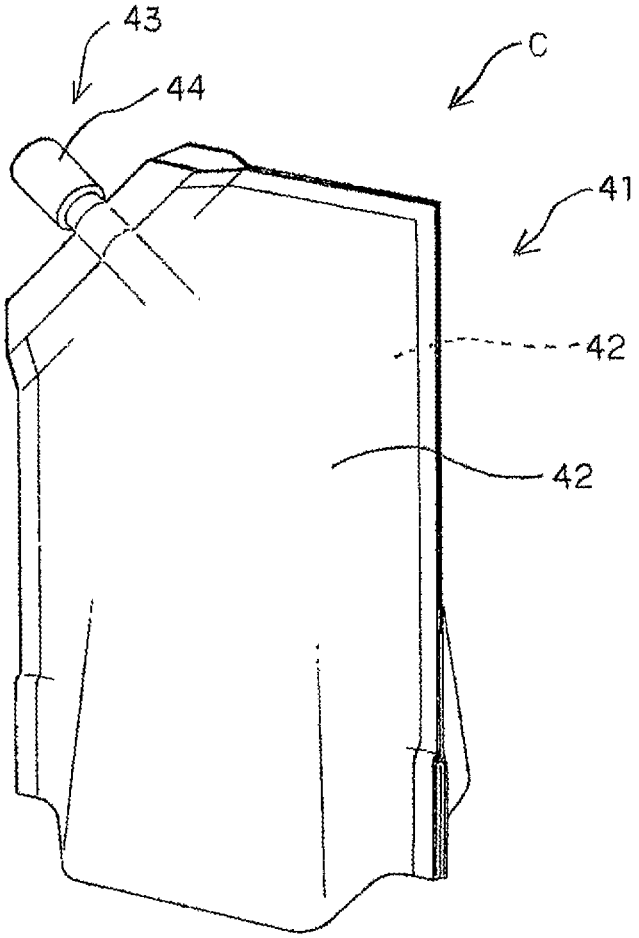
FIG. 12 is a perspective view illustrating a conventional gusset bag C.
Figure 13:
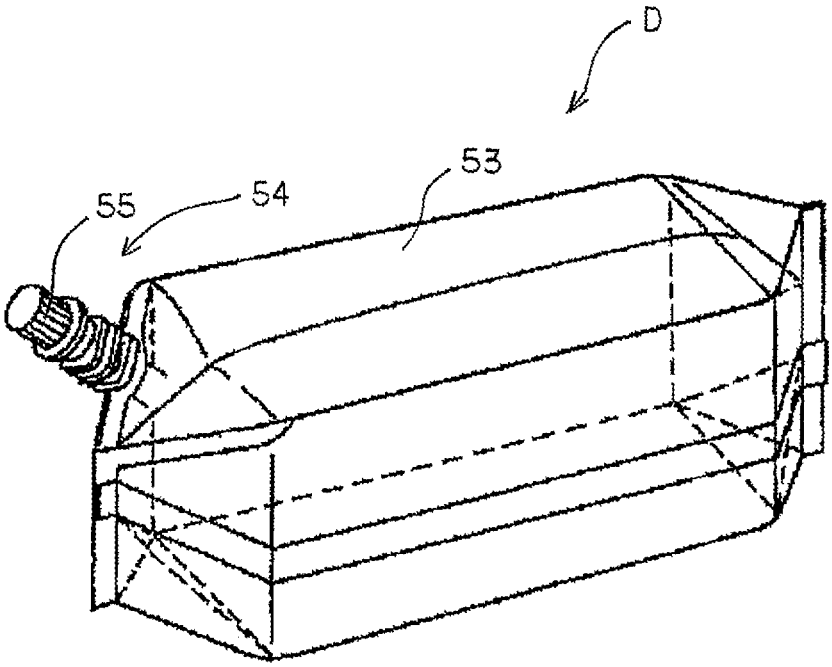
FIG. 13 is a perspective view illustrating a conventional gusset bag D.

FIG. 7 is a partial perspective view illustrating a manner for overlapping a bottom surface portion to an opened lower portion of a tubular body portion, FIG. 8 is a partial perspective view illustrating a state in which the bottom surface portion is overlapped with the lower portion of the opened tubular body portion and an excess portion is then cut off, and FIG. 9 is a perspective view illustrating the tubular body portion to which the bottom surface portion is sealed and secured.

First, as shown in FIG. 7, cuts are formed at four corners of the lower portion of the tubular body portion 3 and the lower portions 5*a* and 6*a* of the flat surface portions 5 and the side surface portion 6 are then opened outward. Next, as also shown in FIG. 7, the opened lower portions of the bottom surface portion 4 and the tubular body portion 3 are folded into V-shapes (turned-up-shape) and the bottom surface portion 4 is then overlapped with the opened lower portions 5*a* and 6*a*. Thereafter, the lower portion of the tubular body portion 3 with which the bottom surface portion 4 is overlapped is folded inward to heat-seal the bottom surface portion 4 to the tubular body portion 3. The heat-sealed portion is shown with (W3) in FIG. 9. In the next step, as shown in FIG. 8, by cutting the excess portions of the lower portion of the tubular body portion 3 and the bottom surface portion 4, the bottom surface portion 4 is finally sealed and secured to the lower edge portion of the tubular body portion 3.

Next, structure and material of the bag body 1 will be explained.

The bag body 1 may be formed of a lamination of at least a base material layer and a heat-sealed layer (i.e., sealant layer), in which the sealant layer constitutes the most inside layer contacting the inner content.

It is preferred for the base material layer to be formed of a film excellent in printability, and having good strength against lunge, high tension strength, and high impact resistance. As a material of the base material layer, there will be listed up, for example, polyethylene terephthalate, polypropylene, polyamide, ethylene vinyl alcohol copolymer, or like, and a biaxially oriented film or uniaxially oriented film of these material will be more preferred. Further, in order to endow a barrier performance to these films against oxygen, water vapor (moisture) or like, it may be preferred to use a metal such as aluminum, magnesium or like, an evaporated film evaporated with oxide such as silicon oxide or like, or a coated film coated with a coating agent having barrier performance such as polyvinylidene chloride. As the base material layer, a single element of the above-mentioned films or a laminated one thereof may be used. It is preferred that the base material layer has a thickness of 6 to 50 μm, and more preferably, of 9 to 30 μm.

The heat-sealed layer is a layer capable of being heat-sealed. As a material of such heat-sealed layer, for example, high-density polyethylene, low-density polyethylene, linear low-density polyethylene, polypropylene or like resins may be used, and non-oriented film of these materials or a multi-layered film formed by co-extruding such resin materials in combination may be preferably used. It is also preferable for the heat-sealed layer to have a thickness of 10 to 200 μm, and more preferably of 20 to 100 μm.

The laminated film may be provided with an intermediate layer between the base material layer and the heat-sealed layer as occasion demands.

Such intermediate layer may be formed of, for example, a film provided with functions or performances such as oxygen barrier property, moisture barrier property, tear property and the like. As a material for such intermediate layer, metal foil such as aluminum, above-mentioned evaporated film, coated film or films having various functions may be adopted. Two intermediate layers may be provided as occasion demands, and it is preferable for the intermediate layer to have a thickness of 6 to 50 μm, and more preferably, of 9 to 30 μm.

The laminated film formed of the base material layer and the sealant layer, and if needed, the intermediate layer, may be manufactured by securing them by known methods such as dry-laminate method using securing and/or sealing agent, extruding laminate method using thermally adhesive agent, and the like.

Further, it may be preferred for the above-mentioned spout 2 to be formed of material like or similar kind of heat-sealed (sealant) layer.

As explained hereinbefore, according to the present invention, the following effects and advantages will be achieved.

(1) The bag body 1 can ensure stable self-standing ability regardless of the remaining amount of the inner content by sealing and securing the rectangular bottom surface portion 4 formed with the foldable line for forming the bottom gusset to the lower edge portion of the tubular body portion 3.

(2) The inner content can be easily poured out regardless of the remaining amount of the inner content, without largely inclining the bag body 1, by forming the inclining edge portion 1*a* to one of the upper two corner portions of the bag body 1 and attaching the spout to the inclining edge portion 1*a*.

(3) The spout 2 can be attached to a predetermined position with the good liquid-tight performance by forming the opening portion 6*b* to the side surface portion 6 of the bag body 1 without making the bog body large.

(4) The inner content can be more easily and completely poured out regardless of the remaining amount of the residual inner content, without largely inclining the bag body 1, by forming the slit 7*b* to the lower portion of the spout body 7 that is inserted into the bag body 1 according to the synergetic effect with the above effect (2) in which the spout 2 is attached to the inclining edge portion 1*a* of the bag body 1.

REFERENCE NUMERALS

1—bag body
1*a*—inclining edge portion
2—spout
3—tubular body portion
4—body surface portion
5—flat surface portion
5*a*—lower portion of flat surface portion
6—side surface portion
6*a*—lower portion of side surface portion
6*b*—opening portion (pulled-out opening portion))
7—spout body
7*a*—pour-out port
7*b*—slit
7*c*—male portion
8—cap
9—attachment portion
10*a*, 10*b*, 10*c*—flanged portion
11—bag body
12—spout
13—cap
14—flat surface portion
15—side surface portion
21—bag body
22—spout
23—tubular body portion
24—bottom surface portion
25—flat surface portion
26—side surface portion
27—cap
41—bag body
42—flat surface portion
43—spout
44—cap
53—bag body
54—spout
55—cap

What is claimed is:

1. A gusset bag with a spout comprising:

a bag body made of a film material, the bag body comprising a tubular body portion comprising a pair of opposing flat surface portions and a pair of side surface portions, each of said side surface portions being secured to side edge portions of the flat surface portions, and a rectangular-shaped bottom surface portion secured to one edge portion of the tubular body portion; and a spout attached to the bag body, wherein the bottom surface portion and the side surface portions are each defined by foldable edges, respectively, a width of each flat surface portion side of the bottom surface portion is wider than a width of a side surface portion side of the bottom surface portion in an extended state of the gusset bag, the bottom surface portion and the side surface portions are folded inward toward an inside of the bag body along said foldable edges, to form a bottom surface gusset and side surface gussets, one of said side surface portions comprises an upper corner portion, and the other of said side surface portions comprises an inclining edge portion at an upper corner area thereof to which said spout is attached, an opening portion is defined by an outwardly-pulled portion of an upper end of one of the inwardly-folded side surface gussets to provide a flat side surface portion to which the spout is attached, and the opening portion is formed only at one side portion of both side surface portions of the spout along an extending direction of the inclining edge portion.

2. The gusset bag provided with a spout according to claim 1, wherein the spout is attached at a right angle to the inclining edge portion of the bag body.

* * * * *